United States Patent [19]

Davis

[11] 4,206,068

[45] Jun. 3, 1980

[54] RED-OX DRAIN CLEANING COMPOSITION

[75] Inventor: Richard G. Davis, Batavia, Ohio

[73] Assignee: The Drackett Company, Cincinnati, Ohio

[21] Appl. No.: 676,821

[22] Filed: Apr. 14, 1976

[51] Int. Cl.[2] ..... C11D 7/06; C11D 7/14

[52] U.S. Cl. ..... 252/89.1; 44/3 R; 44/3 B; 134/40; 252/99; 252/103; 252/105; 252/135; 252/157; 252/188.3 R

[58] Field of Search ..... 252/89, 90, 95, 97, 252/99, 103, 104, 105, 135, 156, 157, 158, 188.3, 387; 44/3 R, 3 B; 134/40

[56] References Cited

U.S. PATENT DOCUMENTS

| | | | |
|---|---|---|---|
| 2,541,345 | 2/1951 | de Navarre et al. | 132/36.2 |
| 2,773,040 | 12/1956 | Walton | 252/157 |
| 3,077,455 | 2/1963 | Racke | 252/157 |
| 3,341,418 | 9/1967 | Moses et al. | 252/90 X |
| 3,353,937 | 11/1967 | Ford et al. | 44/3 R |
| 3,471,407 | 10/1969 | Spring | 252/157 |
| 3,697,431 | 10/1972 | Summerfelt | 252/103 |
| 3,804,771 | 4/1974 | Margolis | 252/188.3 |
| 3,862,866 | 1/1975 | Timmerman et al. | 252/188.3 X |
| 3,968,048 | 7/1976 | Bolan | 252/103 X |

*Primary Examiner*—George F. Lesmes
*Assistant Examiner*—R. Eugene Varndell, Jr.
*Attorney, Agent, or Firm*—Sharon A. Blinkoff; George A. Mentis

[57] ABSTRACT

A drain cleaning composition is provided consisting essentially of 20 to 60 weight percent of an oxidizing agent, 1 to 30 weight percent of a reducing agent, and from about 20 to 75 weight percent of an alkali metal hydroxide, wherein the composition is capable of producing at least 230 calories of heat per gram upon dissolution in water.

1 Claim, No Drawings

RED-OX DRAIN CLEANING COMPOSITION

BACKGROUND OF THE INVENTION

Compositions containing mixtures of reducing agents and oxidizing agents which are capable of producing heat upon interaction thereof (i.e. red-ox mixtures) have long been known in the art. Thus, for example, U.S. Pat. Nos. 3,722,752 to Kenkare et al and 3,772,203 to Gray disclose cosmetic compositions which contain red-ox mixtures for self-heating purposes. U.S. Pat. No. 3,862,866 to Timmerman et al discloses a gas generator composition utilizing a red-ox mixture.

Several patents additionally disclose drain cleaning compositions containing caustic alkali, a wetting or foaming agent and certain additional ingredients which may include reducing agents or oxidizing agents. For example, U.S. Pat. No. 2,997,444 to Martin et al discloses a drain cleaning composition containing sodium hydroxide and an anti-clogging agent such as sodium sulfide or sodium thioglycolate as well as a surface active wetting agent. U.S. Pat. No. 3,697,431 to Summerfelt discloses a drain cleaning composition containing caustic alkali, a surface active wetting agent and potassium hypochlorite as an oxidizing agent. However, neither of these patents discloses compositions containing red-ox mixtures in combination with caustic alkali.

Several patents disclose compositions containing red-ox mixtures with small amounts of alkaline ingredients strictly for pH control. Examples of these are U.S. Pat. Nos. 3,804,771 to Margolis; 3,341,418 to Moses et al; and 3,632,516 to Antonelli et al.

In contrast to the above mentioned prior art, Applicant has herein unexpectedly found that improved drain cleaning performance can be obtained utilizing a drain cleaning composition containing caustic alkali in combination with red-ox mixtures. Such compositions have improved solubility characteristics which tend to prevent the formation of caustic alkaline precipitates of unreacted ingredients in the drainpipe being treated. Additionally, these formulations provide improved clog-dissolving capabilities as well as hair attack capabilities due to the improved heat generating properties of the composition.

SUMMARY OF THE INVENTION

A drain cleaning composition consisting essentially of:

(a) from about 20 to 60 weight percent of an oxidizing agent;

(b) from about 1 to 30 weight percent of a reducing agent; and (c) from about 20 to 75 weight percent of an alkali metal hydroxide, wherein said composition produces upon dissolution in water at least 230 calories of heat per gram of composition and sufficient turbulence to substantially prevent the formation of an insoluble caustic heel, wherein said oxidizing and reducing agents are physically separated until utilization in the presence of water.

Preferred oxidizing agents are alkali metal salts of a member selected from the group consisting of perborate tetrahydrate, persulfate, carbonate peroxide, peroxide and mixtures thereof.

Preferred reducing agents are selected from the group consisting of dextrose, thiourea, an alkali metal salt of thiosulfate and mixtures thereof.

A preferred composition is one consisting of the following ingredients:

thiourea pellets: 4.0 grams
sodium perborate tetrahydrate: 25.0 grams
sodium hydroxide: 30.0 grams
anhydrous sodium silicate: 1.0 gram

DETAILED DESCRIPTION OF THE INVENTION

The drain cleaning compositions in accordance with the invention contain as essential ingredients a reducing agent, an oxidizing agent and an alkali metal hydroxide. The ingredients, of course, may be either in the liquid or crystalline solid form. Preferably, to prevent interaction between the reducing agent and the oxidizing agent prior to use, these ingredients are kept physically separated until actual utilization for drain cleaning purposes. Therefore, for example, the drain cleaning composition can be packaged in a compartmentalized container in which the reducing agent plus sodium hydroxide is maintained in one compartment and the oxidizing agent is maintained in the other compartment. In some instances, the oxidizing agent may be compatible with sodium hydroxide and, therefore, packaged together, while maintaining the reducing agent in a separate compartment. At the time of actual utilization, the ingredients from each compartment are poured simultaneously into the clogged trap and, as they reach the water in the bottom of the trap, reaction begins creating enough heat to bring the temperature of the water near boiling.

Since the drains for most kitchen and bathroom sinks often become clogged with a combination of fatty substances and protein fibers such as hair, it is important that the drain cleaning compositions be able to dissolve both of these types of clogging substances. To effectively dissolve the fatty type of clogging material in a drain, it has been determined that the drain cleaning compositions disclosed herein, which provide at least 230 calories of heat per gram of composition dissolved in water, are most effective in dissolving this type of clogging material. At values much below 230 calories per gram, there is insufficient heat produced to perform an effective drain cleaning function. Furthermore, the drain cleaning compositions disclosed herein will generally have an excess of oxidizing agent which, in combination with hot alkaline solution, proves to be most effective in attacking and dissolving hair, thereby alleviating the other type of clogging problem normally encountered. Finally, it has been observed that the present compositions provide for a controlled amount of turbulence during reaction in the water in a drain trap due to the evolution of gaseous materials resulting from the reaction. These gases, which may for example be oxygen or carbon dioxide, provide for a greater degree of mixing of the ingredients in the drain trap, allowing movement of the drain cleaning mixture to other portions of the piping further removed from the drain trap. This turbulence prevents the formation of an insoluble precipitate of unreacted ingredients called a "caustic heel" which can, more often than not, create a worse clogging problem than that initially encountered before addition of the drain cleaning composition. Such caustic heel formations are frequently encountered when drain cleaning compositions disclosed by the prior art are used.

Generally, between 20 and 75 weight percent of an alkali metal hydroxide is preferred in the compositions disclosed herein. At concentrations below 20 percent, insufficient hair attack is observed; whereas, at concentrations above 75 percent, no noticable improvement in the effectiveness of the drain cleaning composition is observed. The term "alkali metal", which is used herein and throughout the remaining portion of this disclosure, is intended to have its normal accepted meaning in the art. However, because of commercial availability and relatively lower cost, both sodium and potassium hydroxide are preferred for use herein.

Many combinations of oxidizing and reducing agents can be utilized as is generally known in the art, provided they meet the required criteria for use in drain cleaning compositions, as previously discussed. For example, the compositions must provide the required heat evolution upon dissolution in water (i.e. at least 230 calories per gram), and also be soluble and provide turbulence effects to prevent the formation of an insoluble caustic heel in the drain trap. Additionally, the proportions of oxidizing to reducing agent can be balanced so that an excess of one or the other would be available for reaction with the materials clogging the drain, and after the heat producing reaction has been completed. Thus, an excess of oxidizing agent has been observed to improve the capability for hair attack by sodium hydroxide.

With respect to the oxidizing agent, it has been generally found that 20 to 60 weight percent in the composition provides a sufficient amount of this ingredient to result in the required evolution of heat and a slight excess of the oxidizing agent for hair attack, as described above. Although many known oxidizing agents can be used, those preferred are alkali metal salts of perborates, persulfates, carbonate-peroxides and peroxide such as sodium persulfate ($Na_2S_2O_8$), sodium perborate monohydrate or tetrahydrate ($NaBO_2 . H_2O_2 . H_2O$ or $NaBO_2 . H_2O_2 . 3H_2O$), sodium carbonate-peroxide ($Na_2CO_3 . H_2O_2 . \frac{1}{2}H_2O$) and sodium peroxide ($Na_2O_2$). Others might be used, such as potassium permanganate ($KMnO_4$), potassium dichromate ($K_2Cr_2O_7$), lithium hypochlorite (Li O CL), potassium peroxymonosulfate ($KHSO_5$) or sodium dichloroisocyanurate ($Cl_2Na(NCO)_3$).

With regard to the reducing agents, generally from 1 to 30 weight percent has been found to be sufficient to react with all or part of the oxidizing agent to provide the required heat generation. Preferred reducing agents are sodium thiosulfate ($Na_2S_2O_3$), reducing sugars ($C_6H_{12}O_6$ etc.), and thiourea ($[NH_2]_2CS$). Others may be used, such as sodium bisulfite (NA $HSO_3$), sodium borohydride ($NaBH_4$), hydrazine salts $NH_2NH_2 . H_2SO_4$ etc.), sodium hypophosphite ($NaH_2PO_2 . H_2O$).

The following red-ox mixtures having varying degrees of caustic alkalinity are examples of those which could be used in accordance with the invention:

| Oxidizing Agent | Reducing Agent |
|---|---|
| potassium peroxymonosulfate, $KHSO_5$ | - sodium chloride NaCl |
| lithium hypochlorite, LiOCl | - thiourea, $(NH_2)_2$ CS |
| K and Na dichloroisocyanurate, $(Cl_2Na(NCO)_3)$ | - thiourea, $(NH_2)_2$ CS |
| sodium peroxide, $Na_2O_2$ | - thiourea, $(NH_2)_2$ CS |
| sodium peroxide, $Na_2O_2$ | - sodium thiosulfate, $Na_2S_2O_3$ |
| sodium peroxide, $Na_2O_2$ | - sodium sulfite, $Na_2SO_3$ |
| sodium peroxide, $Na_2O_2$ | - sodium bisulfite, $NaHSO_3$ |
| sodium peroxide, $Na_2O_2$ | - sodium phosphite, $Na_2HPO_3$ |

-continued

| Oxidizing Agent | Reducing Agent |
|---|---|
| sodium peroxide, $Na_2O_2$ | - sodium hypophosphite, $NaH_2PO_2$ |
| sodium peroxide, $Na_2O_2$ | - sodium nitrite, $NaNO_2$ |
| sodium peroxide, $Na_2O_2$ | - sucrose or dextrose, $C_6H_{12}O_6$ |
| sodium perborate monohydrate, $NaBO_2 . H_2O_2 . H_2O$ | - sucrose or dextrose, $C_6H_{12}O_6$ |
| sodium perborate tetrahydrate, $NaBO_2 . H_2O_2 . 3H_2O$ | - sucrose or dextrose, $C_6H_{12}O_6$ |
| sodium carbonate-peroxide, $Na_2CO_3 . H_2O_2 . \frac{1}{2}H_2O$ | - sucrose or dextrose $C_6H_{12}O_6$ |
| sodium carbonate-peroxide, $Na_2CO_3 . H_2O_2 . \frac{1}{2}H_2O$ | - sodium thiosulfate, $Na_2S_2O_3$ |
| sodium carbonate-peroxide, $Na_2CO_3 . H_2O_2 . \frac{1}{2}H_2O$ | - thiourea, $(NH_2)_2CS$ |
| sodium carbonate-peroxide, $Na_2CO_3 . H_2O_2 . \frac{1}{2}H_2O$ | - lactose, $C_{12}H_{22}O_{11}$ |
| sodium carbonate-peroxide, $Na_2CO_3 . H_2O_2 . \frac{1}{2}H_2O$ | - urea, $(NH_2)_2$ CO |
| potassium peroxymonosulfate, $KHSO_5$ | - thiourea, $(NH_2)_2$ CS |
| potassium peroxymonosulfate, $KHSO_5$ | - sodium thiosulfate, $Na_2S_2O_3$ |
| potassium persulfate, $K_2S_2O_8$ | - sodium bisulfite, $NaHSO_3$ |
| potassium persulfate, $K_2S_2O_8$ | - dextrose, $C_6H_{12}O_6$ |
| sodium persulfate, $Na_2S_2O_8$ | - Igepal DM 970 (GAF) |
| sodium persulfate, $Na_2S_2O_8$ | - Pluronic F 127 (BASF) |
| sodium persulfate, $Na_2S_2O_8$ | - Polawax (Croda) |
| lithium hypochlorite, LiOCl | - ethylene glycol $[(CH_2)_2(OH)_2]$ |
| lithium hypochlorite, LiOCl | - glycerine, $CHOH (CH_2OH)_2$ |
| periodic acid, $HIO_4$ | - ethylene glycol $[(CH_2)_2 (OH)_2]$ |
| periodic acid, $HIO_4$ | - glycerine, $CHOH (CH_2OH)_2$ |

The following red-ox mixtures having varying degrees of caustic alkalinity would be unsatisfactory for drain cleaner compositions in accordance with this invention:

| Oxidizer | Reducer |
|---|---|
| sodium perborate, $NaBO_2 . H_2O_2 . 3H_2O$ | - sodium nitrite, $NaNO_2$ |
| sodium carbonate-peroxide, | - sodium nitrite, $NaNO_2$ |
| potassium nitrate | - sodium thiosulfate |

Certainly these are not a complete list of all combinations that could or could not be used in the drain cleaner. Any of the alkali metals could be used in place of the ones specifically mentioned. Certainly organic oxidizing agents could be used, but are not preferred because of general instability problems at higher temperatures, and cost. Any attempt at classifying the oxidizers and reducers that produce an effective formulation is difficult. In general, it is necessary for the reactants to be soluble in water and caustic solutions. They should be stable at elevated temperatures. The redox reaction should produce enough turbulence to dissolve the formulation completely. This is usually accomplished by the release of gaseous oxygen from the oxidizer but that is not to say it is the only way to produce a turbulent reaction. The oxidizer should be of a strong enough nature to react with the reducing agent of choice without producing excessive turbulence or a large volume of insoluble precipitate. Either the oxidizer or the reducer must be compatible with anhydrous alkali metal hydroxide in order to package the product in a dual compartment pouch.

Additional optional ingredients such as perfumes, dyes, wetting agents, corrosion inhibitors, etc. can be added to the drain cleaning compositions to provide preferred properties thereto. Wetting agents that are compatible with the ingredients in the composition can be included to increase the rate at which the drain opener penetrates the fatty substance which clogs the drain or, in other instances, to provide foaming properties to increase the degree of contact of the drain cleaning composition with the clogging materials. Examples of such wetting agents are sodium alpha olefin sulfonates (e.g. Ultra Wet AOK) and ethoxylated alcohols.

Corrosion inhibitors, such as alkali metal silicates may be added to prevent metal attack of the plumbing fixtures by the drain cleaning composition. Also, to provide a dry, free-flowing mixture with sodium hydroxide, a desiccant (e.g. powdered alumina, powdered sodium silicate and magnesium sulfate) is added in small amounts. Generally, the concentration for each type of optional additive is less than about 5 weight percent.

In some cases, it has been found that the drain cleaning compositions produce an excessive amount of turbulence in the drain trap. To slow down the degree of turbulence which is a direct result of the interaction of the red-ox ingredients, it has been found desirable to pelletize one or more of these ingredients. Thus, a highly preferred drain cleaning composition, in accordance with the present invention, is one having the following composition:

thiourea pellets: 4.0 grams
sodium perborate tetrahydrate: 25.0 grams
sodium hydroxide: 30.0 grams
anhydrous sodium silicate: 1.0 gram The pelletized thiourea was made by mixing 76.05 weight percent thiourea, 19.01 weight percent of Ultra Wet AOK and 4.94 weight percent of Sunflex 107 oil (the weight percentages being based on the 4 gram weight of thiourea pellets) and running this mixture through a pelletizing mill to produce pellets having a size such that they pass through an 8 U.S. sieve mesh and are retained on a 14 U.S. sieve mesh. The Sunflex 107 oil is a mineral oil having a viscosity of 68–75 Saybolt Universal Seconds at 100° F. Of course, other types of mineral oils can be used in its place.

For purposes of the disclosure herein, it is understood that the concept of oxidation-reduction (referred to as "red-ox") is that interaction which occurs between the two reagents when they are brought together under proper conditions resulting in an exchange of electrons. The reagent that is the electron donor is referred to as the reducing agent and the electron accepting reagent is the oxidizing agent.

In the examples that follow, it is to be understood that they are merely illustrative of the present invention, and should not be deemed as limiting the scope of the invention which is defined by the appended claims.

The test procedure and criteria used to evaluate the effectiveness of the drain cleaning compositions in accordance with the present invention was as follows:

(a) Solubility was determined by observation of a 50 to 60 gram charge of the formula in a 1¼ inch glass drain trap containing 250 ml tap water. If the formula was not completely dissolved within a 15 minute period, or if there was evidence of formation of precipitates the composition was considered unsatisfactory.

(b) Turbulence during the process of solubilizing was considered a necessary parameter for the compositions tested. Turbulence greatly increases the rate of solubilization and helps to dislodge a clog from a drain. Controlled turbulence provides a means for pushing a quantity of hot alkaline solution up out of the "U" bend of a drain trap and out into the lateral line away from the trap in order to attack clogs that might occur in this lateral line. The degree of turbulence was observed for each charge of material in the 1¼ inch glass trap containing 250 ml tap water. Compositions providing excessive amounts of turbulence or no turbulence whatsoever were considered unsatisfactory.

(c) Heat production of a given formula was determined by dissolving a 50 to 60 gram charge in 800 l ml deionized water in a calorimeter. The temperature rise in degrees centigrade (i.e. T) over a 30 minute period was noted on a centigrade thermometer and the calories of heat produced were determined by the following equation.

$$\text{Calories/gm of charge} = (T \times 800)/\text{Charge (grams)}$$

T = temp. rise in degrees centigrade
C = Total charge of material in grams (d) Rate of hair attack was also determined. This was done by suspending 1 gram of hair in 250 ml tap water in an 1¼ inch glass trap, adding the formulation and determining how long it took for the hair to completely dissolve.

EXAMPLE 1

| | | |
|---|---|---|
| thiourea, $(NH_2)_2CS$ | 4g | 7.4% |
| sodium perborate, tetrahydrate $NaBO_2 . H_2O_2 . 3H_2O$ | 20g | 37.1% |
| sodium hydroxide, NaOH | 30g | 55.5% |
| Total charge - | 54g | 100.0% |

solubility in glass and metal traps was complete with no precipitate formation.

Turbulence tended to be more intense than was desirable, especially in a metal trap.

This formula was maximized for heat generation in a calorimeter and the area between 4 and 6 grams thiourea produced maximum heat— 268 calories/gram.

1 gram hair was solubilized within 3 minutes.

EXAMPLE 2

| | | |
|---|---|---|
| thiourea, $(NH_2)_2CS$ | 1g | 1.8% |
| sodium persulfate, $Na_2S_2O_8$ | 25g | 44.6% |
| sodium hydroxide, NaOH | 30g | 53.6% |
| Total charge - | 56g | 100.0% |

Solubility and turbulence were good in a glass trap. 13,200 calories of heat were produced in calorimeter tests, or 236 cal/gram. The maximum heat production was obtained with 4 grams thiourea, 277 calories/gram, however, the rate of the reaction became undesirable at this level.

A one gram charge of hair was completely dissolved by this formula in 3 minutes.

EXAMPLE 3

| | | |
|---|---|---|
| thiourea, $(NH_2)_2CS$ | 1.0g | 1.7% |
| sodium thiosulfate, $Na_2S_2O_3$ | 1.0g | 1.7% |
| sodium metasilicate anhydrous $Na_2SiO_3$ | 1.0g | 1.6% |
| Ultrawet AOK, alpha olefin sulfonate | 0.75g | 1.2% |
| sodium persulfate, $Na_2S_2O_8$ | 22.0g | 36.2% |

-continued

| | | |
|---|---|---|
| sodium hydroxide, NaOH | 35.0g | 57.6% |
| Total charge - | 60.75g | 100.0% |

Sodium thiosulfate was employed in the above formulation to provide a little more control of turbulence while increasing the amount of heat produced.

The sodium metasilicate was used as a desiccant under storage conditions and as a corrosion inhibitor for metal traps.

Alpha olefin sulfonate increased the foam production, thus increasing the amount of solution that could be forced up out of a drain trap and into the lateral line.

Solubility and turbulence were satisfactory in a glass trap but the latter was somewhat greater in a metal trap.

Calorimeter studies showed a maximum of 16,160 calories of heat produced, or 262 calories gram.

EXAMPLE 4

| | | |
|---|---|---|
| dextrose, $C_6H_{12}O_6$ | 18.0g | 26.4% |
| sodium carbonate peroxide $Na_2CO_2 . \frac{1}{2}H_2O$ | 20.0g | 29.4% |
| sodium hydroxide, NaOH | 30.0g | 44.2% |
| Total charge - | 68.0g | 100.0% |

Solubility in glass trap containing 250 ml tap water was essentially complete within 15 minutes.

Turbulence was good and one gram hair was completely dissolved within 3 minutes.

The formula was optimized for heat production by varying the quantities of dextrose and carbonate-peroxide. Maximum heat of 279 calories/gram was attained at 18 grams dextrose, 20 grams sodium carbonate-peroxide.

Attack on one gram hair essentially complete within 3 minutes.

EXAMPLE 5

| | |
|---|---|
| sodium thiosulfate, $Na_2S_2O_3$ | 5.0g |
| sodium peroxide, $Na_2O_2$ | 10.0g |
| sodium hydroxide, NaOH | 35.0g |
| Total charge - | 50.0g |

Solution rate was rapid with much turbulence.

One gram hair was dissolved in 2 minutes. Heat was optimized by varying the quantities of sodium thiosulfate between 2 and 8 grams.

The 2 gram addition gave a value of 253 cal./gram.

The 8 gram addition gave 255 cal/gram.

With the 5 gram addition the value was 264 cal/gram.

EXAMPLE 6

| | |
|---|---|
| thiourea, $(NH_2)_2CS$ | 3.0g |
| sodium peroxide, $Na_2O_2$ | 10.0g |
| sodium hydroxide, NaOH | 35.0g |
| Total charge - | 48.0g |

Complete solubility of reactants was achieved within 1 minute in a glass trap containing 250 ml tap water.

Much turbulence was observed during reaction.

3, 5 and 8 gram samples of thiourea were incorporated into the formula and run in calorimeter. 3 grams gave a heat value of 359 cal/gram, 5 grams a value of 351 cal/gram and 8 grams gave 332 cal/gram.

1 gram hair was dissolved in 2 minutes.

All of the above formulations produced somewhat excessive turbulence in metal traps. Evidently the brass of a metal trap catalyzes the reaction making it much more rapid that in a glass trap.

In an attempt to slow down the rate of reaction and therefore the degree of turbulence, the particle size of one of the reactants was increased.

EXAMPLE 7

Pelletized thiourea containing 76.05 thiourea, 19.01% Ultrawet AOK (alpha olefin sulfonate) and 4.94% Sunflex 107 oil was made by mixing the ingredients and running the resulting mixture through a pelletizing mill. The pellets produced which were of a size such that they passed through an 8 mesh U.S. sieve screen, but were retained on a 14 mesh U.S. sieve screen. These pellets were used in the following formula:

| | | |
|---|---|---|
| thiourea pellets, $(NH_2)_2CS$ | 4.0g | 6.7% |
| sodium perborate tetrahydrate $NaBO_2 . H_2O_2 . 3H_2O$ | 25.0g | 41.7% |
| sodium hydroxide, NaOH | 30.0g | 50.0% |
| sodium silicate anhydrous, $Na_2SiO_3$ | 1.0g | 1.6% |
| Total charge - | 60.0g | 100.0% |

In a glass trap containing 250 ml tap water a steady controlled turbulence could be maintained for about 2 minutes. The charge was completely dissolved within this 2 minute period. Similar results were obtained in metal traps.

One gram of hair was completely dissolved within 2 minutes. Calorimeter tests showed a total heat production of 15,600 calories, or 260 calories/gram of charge.

Additionally, satisfactory drain cleaning compositions are those in Examples 8 and 9.

EXAMPLE 8

| | |
|---|---|
| sodium thiosulfate, $Na_2S_2O_3$ | 11.8% |
| sodium perborate tetrahydrate $NaBO_2 . H_2O_2 . 3H_2O$ | 44.1% |
| sodium hydroxide, NaOH | 44.1% |
| | 100.0% |

EXAMPLE 9

| | |
|---|---|
| sodium thiosulfate, $Na_2S_2O_3$ | 1.8% |
| sodium persulfate, $Na_2S_2O_8$ | 44.6% |
| sodium hydroxide, NaOH | 53.6% |
| | 100.0% |

The following drain cleaning compositions in Examples 10–12 were unsatisfactory.

EXAMPLE 10

| | |
|---|---|
| sodium thiosulfate, $Na_2S_2O_3$ | 6.4g |
| potassium dichromate, $K_2Cr_2O_7$ | 2.0g |
| sodium hydroxide, NaOH | 30.0g |
| Total charge - | 38.4g |

No turbulence was produced and a hard heel was left in trap.

EXAMPLE 11

| | |
|---|---|
| thiourea, $(NH_2)_2CS$ | 6.0g |
| potassium dichromate, $K_2Cr_2O_7$ | 2.0g |
| sodium hydroxide, NaOH | 30.0g |
| Total charge - | 38.0g |

Very little turbulence and much undissolved material left in glass trap.

EXAMPLE 12

| | |
|---|---|
| potassium nitrate, $KNO_3$ | 20.0g |
| dextrose, $C_6H_{12}O_6$ | 16.0g |
| sodium hydroxide, NaOH | 30.0g |
| Total charge - | 66.0g |

In a glass trap maximum temperature reached 220° F., but absolutely no turbulence was observed, and the dextrose was carbonized into a hard heel in bottom of trap.

What is claimed is:

1. A drain cleaning composition consisting of the following ingredients:

thiourea pellets: 4.0 grams
sodium perborate tetrahydrate: 25.0 grams
sodium hydroxide: 30.0 grams
anhydrous sodium silicate: 1.0 grams wherein said thiourea pellets consist of a mixture containing 76.05 weight percent thiourea, 19.01 weight percent sodium alpha olefin sulfonate and 4.94 weight percent of a mineral oil, and said pellets are of a size which are capable of passing through the openings of an 8 mesh U.S. sieve screen but are retained by a 14 mesh U.S. sieve screen.

* * * * *